US008154487B2

(12) United States Patent
Yuuki et al.

(10) Patent No.: US 8,154,487 B2
(45) Date of Patent: Apr. 10, 2012

(54) DISPLAY APPARATUS

(75) Inventors: Osamu Yuuki, Tokyo (JP); Hideo Mori, Yokohama (JP); Noriyuki Shikina, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1012 days.

(21) Appl. No.: 11/766,887

(22) Filed: Jun. 22, 2007

(65) Prior Publication Data

US 2008/0001875 A1 Jan. 3, 2008

(30) Foreign Application Priority Data

Jun. 30, 2006 (JP) ..... 2006-181667

(51) Int. Cl.
*G09G 3/36* (2006.01)

(52) U.S. Cl. ..... 345/87; 313/500; 315/366

(58) Field of Classification Search ..... 345/80–87, 345/39–49, 55, 63, 76, 100, 690; 313/504–582; 315/165–173
See application file for complete search history.

(56) References Cited

U.S. PATENT DOCUMENTS 6,501,466 B1 12/2002 Yamagishi
6,825,820 B2 * 11/2004 Yamazaki et al. ..... 345/76
6,831,405 B2 * 12/2004 Kim et al. ..... 313/503
7,009,627 B2 3/2006 Abe
2005/0017630 A1 * 1/2005 Ryu et al. ..... 313/504
2005/0231107 A1 * 10/2005 Yamazaki et al. ..... 313/506
2006/0038836 A1 2/2006 Abe

FOREIGN PATENT DOCUMENTS

JP 2001147659 5/2001
JP 2003255884 9/2003

OTHER PUBLICATIONS

Tang, et al.; "Organic electroluminescent diodes",Appl. Phys. Lett. 51 (12); pp. 913-915; American Institute of Physics (1987).
Tang, et al.; "Electroluminescence of doped organic thin films", J. Appl. Phys. 85 (9), pp. 3610-3616; American Institute of Physics (1989).
Office Action issued on Jul. 24, 2007 by the European Patent Office.

* cited by examiner

*Primary Examiner* — Amare Mengistu
*Assistant Examiner* — Vinh Lam
(74) *Attorney, Agent, or Firm* — Fitzpatrick, Cella, Harper & Scinto

(57) ABSTRACT

In a display apparatus, a plurality of pixels including light emitting elements emitting colors of R, G and B, is arranged on a single surface. To each pixel, corresponding R image signal wiring, G image signal wiring, and B image signal wiring, are connected. Wirings are arranged so that the resistance or the capacitance of each image signal wiring differs every color of corresponding pixels, and by this, the rise times of the signal for R, G and B will be substantially equal to each other. The resistance value is changed by adjusting the width, the thickness, or the specific resistance of the material of the image signal wiring, or the capacitance is changed by adjusting the thickness of the insulator or the relative dielectric constant of the material while sandwiching an insulator between the image signal wiring and a scanning wiring at the intersection of them.

2 Claims, 16 Drawing Sheets

| MATERIAL | RESISTIVITY (μ Ω cm) |
|---|---|
| Mo | 5.00 |
| Cr | 12.70 |
| Al | 2.50 |
| Cu | 1.55 |
| Ag | 1.47 |
| Au | 2.05 |

| MATERIAL | DIELECTRIC CONSTANT |
|---|---|
| SiO2 | 4.00 |
| Si3N4 | 9.00 |
| Ta2O5 | 25.0 |

| | | | | | |
|---|---|---|---|---|---|
| VOLTAGE (V) | 10 | 33.12 | 39.74 | 49.68 | |
| | 9 | 29.81 | 35.77 | 44.71 | |
| | 8 | 26.50 | 31.79 | 39.74 | |
| | 7 | 23.18 | 27.82 | 34.78 | |
| | 6 | 19.87 | 23.85 | 29.81 | |
| | 5 | 16.56 | 19.87 | 24.84 | |
| | 4 | 13.25 | 15.90 | 19.87 | |
| | 3 | 9.94 | 11.92 | 14.90 | |
| | 2 | 6.62 | 7.95 | 9.94 | |
| | 1 | 3.31 | 3.97 | 4.97 | |
| CURRENT | | 60μA | 166μA | 159μA | |
| DATA LINE RESISTANCE (BETWEEN START AND END POSITIONS) | | 100.0kΩ | 120.0kΩ | 150.0kΩ | |
| DATA LINE CAPACITANCE +HOLD CAPASITANCE | | 35pF | 35pF | 35pF | |
| | | | | | |
| TIME (msec) TAKEN TO CHARGE DATA LINE CAPACITANCE AND HOLD CAPASITANCE | | | | DELAY TIME (μsec) | |

FIG. 16

| VOLTAGE (V) | | | | | | | | | | | | |
|---|---|---|---|---|---|---|---|---|---|---|---|---|
| 3 | 0.371 | 0.186 | 0.124 | 0.093 | 0.074 | 0.062 | 0.053 | 0.046 | 0.041 | 0.037 | 0.032 | 0.029 |
| 2.7 | 0.318 | 0.159 | 0.106 | 0.079 | 0.064 | 0.053 | 0.045 | 0.040 | 0.035 | 0.032 | 0.028 | 0.025 |
| 2.4 | 0.282 | 0.141 | 0.094 | 0.071 | 0.056 | 0.047 | 0.040 | 0.035 | 0.031 | 0.028 | 0.025 | 0.022 |
| 2.1 | 0.247 | 0.124 | 0.082 | 0.062 | 0.049 | 0.041 | 0.035 | 0.031 | 0.027 | 0.025 | 0.022 | 0.019 |
| 1.8 | 0.212 | 0.106 | 0.071 | 0.053 | 0.042 | 0.035 | 0.030 | 0.026 | 0.024 | 0.021 | 0.018 | 0.017 |
| 1.5 | 0.176 | 0.088 | 0.059 | 0.044 | 0.035 | 0.029 | 0.025 | 0.022 | 0.020 | 0.018 | 0.015 | 0.014 |
| 1.2 | 0.141 | 0.071 | 0.047 | 0.035 | 0.028 | 0.024 | 0.020 | 0.018 | 0.016 | 0.014 | 0.012 | 0.011 |
| 0.9 | 0.124 | 0.062 | 0.041 | 0.031 | 0.025 | 0.021 | 0.018 | 0.016 | 0.014 | 0.012 | 0.011 | 0.010 |
| 0.6 | 0.071 | 0.035 | 0.024 | 0.018 | 0.014 | 0.012 | 0.010 | 0.009 | 0.008 | 0.007 | 0.006 | 0.006 |
| 0.3 | 0.035 | 0.018 | 0.012 | 0.009 | 0.007 | 0.006 | 0.005 | 0.004 | 0.004 | 0.004 | 0.003 | 0.003 |
| | 80.8 | 161.6 | 242.4 | 323.2 | 404 | 484.8 | 565.6 | 646.4 | 727.2 | 808 | 927 | 1028 |
| | CURRENT (mA) | | | | | | | | | | | |

| | |
|---|---|
| FRAME SCANNING TIME (/sec) | 60 |
| NUMBER OF SCANNING LINES (LINE SEQUENTIAL QVGA) | 240 |
| SCANNING TIME PER ONE SCANNING | 0.069msec |

DELAY TIME (msec)

| | |
|---|---|
| DATA LINE CAPACITANCE | 10pF |

TIME (msec) TAKEN TO CHARGE DATA LINE

DISPLAY APPARATUS

BACKGROUND OF THE INVENTION

1. Field of the Invention

The present invention relates to a display apparatus, and in particular, to a display apparatus including an organic electroluminescent (hereinafter, abbreviated as "EL") element.

2. Description of the Related Art

As a light emitting element used for a display apparatus, a light emitting diode (hereinafter, abbreviated as "LED") has been paid attention in recent years. With regard to drive methods of the light emitting element, a current drive method or a voltage drive method have been proposed. Hereinafter, taking the case of a current drive type organic EL element which is used as the light emitting element, a prior art light emission drive will be described.

The organic EL element is also referred to as an organic LED (OLED: Organic Light Emitting Diode), and it enables a plane-shaped spontaneous light emission in which high brightness light emission is possible, to be obtained. As described in C. W. Tang etc., "Organic electroluminescent diodes", Applied Physics Letters, pages 913 to 915, volume 51, 1987, and C. W. Tang etc., "Electroluminescent of doped organic thin films", Journal of Applied Physics, pages 3610 to 3616, volume 65, 1989, the EL element is arranged to emit light in high efficiency at low voltage, with organic layers which serve as light emitting layers, being stacked between a pair of electrodes (anode and cathode) depending on the function thereof, and by increasing the number of the stacked functional organic layers.

The basic element configuration of the organic EL element includes an EL light emission layer having an organic layer and hole transport layer between an anode and a cathode, and a stacked structure of anode/hole transport layer/EL light emission layer/cathode. Based on the element configuration, by adding an electron transport layer having an organic layer between the EL light emission layer and the cathode to form a stacked structure of anode/hole transport layer/EL light emission layer/electron transport layer/cathode, high efficiency has been devised.

Further, in some cases, in order to prevent carriers from passing through the EL light emission layer, a blocking layer is provided between the EL light emission layer and the electron transport layer, or, a metal thin film as an electron injection layer is provided between the cathode and the electron transport layer, so as to enable injection of the carriers to be performed under low voltage. With these, the improvement of the light emission efficiency has been devised.

In such a display element using the organic EL element as a light emitting element, by injecting holes and electrons into the light emission layer, light emission brightness is controlled. As drive methods for the display element, an active matrix type constant voltage drive or a constant current drive, is known, which has Thin Film Transistor (hereinafter abbreviated as "TFT") such as that disclosed in Japanese Patent Application Laid-open No. 2001-147659. Since it emits light spontaneously by these drives, the organic EL element is going to be integrated to be high-density and used as a display element device. Moreover, by using organic EL elements emitting red (R), green (G) and blue (B) color, respectively, a full color thin film display can also be achieved.

With regard to image signal wirings used for the above-mentioned display element, as illustrated in FIG. 25, an image signal wiring 76 connected to R pixel, an image signal wiring 77 connected to G pixel, and an image signal wiring 78 connected to B pixel, are usually patterned so as to have a same width and thickness of a same material.

However, in a case of constant voltage drive type display element of Prior Art Embodiment, in order to cause the light emitting element to emit light between electrodes or through TFT by using constant voltage, charge time or discharge time of parasitic capacitance charges under current reduced due to the resistance of the image signal wirings from the source to the pixel circuit, will be required. If a scanning signal wiring falls into a non-selected state when the charge or the discharge of charges into or from the parasitic capacitance has not yet completed, light emission of the organic EL light emitting element will occur when the brightness which does not reach to a predetermined value. The charge-discharge time at this time will be shorter when the image signal voltage is low, and will be longer when the image signal voltage is high. Accordingly, as the light emission voltage of the constant voltage drive light emitting element is lower and the brightness thereof is higher, the image signal voltage will be smaller and the charge-discharge time will be shorter. Conversely, when a predetermined brightness cannot be obtained unless the light emission voltage of the light emitting element is high, the image signal voltage will be higher and the charge-discharge time will be longer.

A case where the display element is applied to a color-matrix display element having a plurality of light emitting elements corresponding to respective colors of R, G and B will be considered. In the case, when the light emission voltage of the light emitting element of B is low, and the light emission voltage of R is high, although depending on the white balance ratio thereof, in many cases, the image signal voltage of R will be higher and the image signal voltage of B will be lower. For this reason, as illustrated in FIG. 26, when stripes of a black color stripe (black stripe) 83 and a white color stripe (white stripe) 81 are displayed on the display element 1, at the upper part of the white stripe 81, blue color 80, an image signal voltage of which is low and a charge-discharge time of which is short, will begin to be displayed first (blue smear display). On the other hand, on the upper part of the black stripe 83, red color 82, an image signal voltage of which is low and a charge-discharge time of which is long, will be remained being displayed (red smear display).

Moreover, in a case of constant current drive type display element of Prior Art Embodiment, in order to cause the light emitting element to emit light between electrodes or through TFT by using constant current, charge time or discharge time of parasitic capacitance charges will be required until the compensation voltage due to the resistance of the image signal wirings is increased. If a hold signal wiring is in a non-selected state at a stage when the charge or the discharge of charges into or from the capacitance is not completed, light emission of the organic EL light emitting element will occur at a stage when the brightness thereof does not reach to a predetermined value. The charge-discharge time at that time will be shorter when the image signal current is large, and will be longer when the image signal voltage is small. Accordingly, when a predetermined brightness cannot be obtained unless the current efficiency of the constant current drive light emitting element is low and the light emission current thereof is large, the image signal current will be larger and the charge-discharge time will be shorter. Conversely, even if the current efficiency of the constant current drive light emitting element is high and the light emission current thereof is small, since the brightness is higher the image signal current will be smaller, the charge-discharge time will be longer.

A case where the display element is applied to a color-matrix display element having a plurality of light emitting elements corresponding to respective colors of R, G and B will be considered. In the case, when the light emission current of the light emitting element of B is large, and the light emission current of R is small, although depending on the white balance ratio thereof, in many cases, the image signal current of R will be smaller and the image signal current of B will be larger. For this reason, as illustrated in FIG. 26, when the stripes of the black stripe 83 and the white stripe 81 are displayed on the display element 1, on the upper part of the white stripe 81, blue color 80, an image signal current of which is large and a charge-discharge time of which is short, will begin to be displayed first. On the other hand, on the upper part of the black stripe 83, red color 82, an image signal current of which is small and a charge-discharge time of which is long, will be remained being displayed. As the countermeasure to this, in order to cause the charge-discharge time to be shorter, use of a low efficiency light emitting element that emits light at large current for all colors can be considered. However, in the case, there is a disadvantage of power consumption.

In relation to the above, Japanese Patent Application Laid-open No. 2003-255884 discusses a drive control apparatus equipped with a unit for compensating and controlling the brightness change due to a voltage drop occurs by the resistance part of wirings using a drive circuit. However, in the apparatus, in order to control these, a large-scale drive circuit has been required.

SUMMARY OF THE INVENTION

It is an aspect of the present invention to provide a display apparatus including: an array of light emitting elements in which light emitting elements of different colors are arranged periodically in a row direction and light emitting elements of a same color are arranged in a column direction; a plurality of scanning signal wirings connecting the light emitting elements in the row direction; and a plurality of image signal wirings connecting the light emitting elements in the column direction, wherein wiring resistance or wiring capacitance of each image signal wiring differs depending on the color of the light emitting elements in a corresponding column.

The wiring resistance or the wiring capacitance differs depending on the color so as to reduce ununiformness of rise times of a voltage supplied to the image signal wiring.

According to the present invention, in the display element whose drive voltage or drive current to the light emitting element differs depending on each color, it will be possible to shorten the time lag between the charge-discharge times, caused due to the wiring resistance and the capacitance on a drive substrate, without using a large-scale drive circuit. This enables the current drive display element to display an image well without smear except for the display image.

Further features of the present invention will become apparent from the following description of exemplary embodiments with reference to the attached drawings.

BRIEF DESCRIPTION OF THE DRAWINGS

FIG. 16 is a view describing times required to charging the capacitance of respective Embodiment, in Fourth to Sixth Embodiments.

DESCRIPTION OF THE EMBODIMENTS

Figure 1:
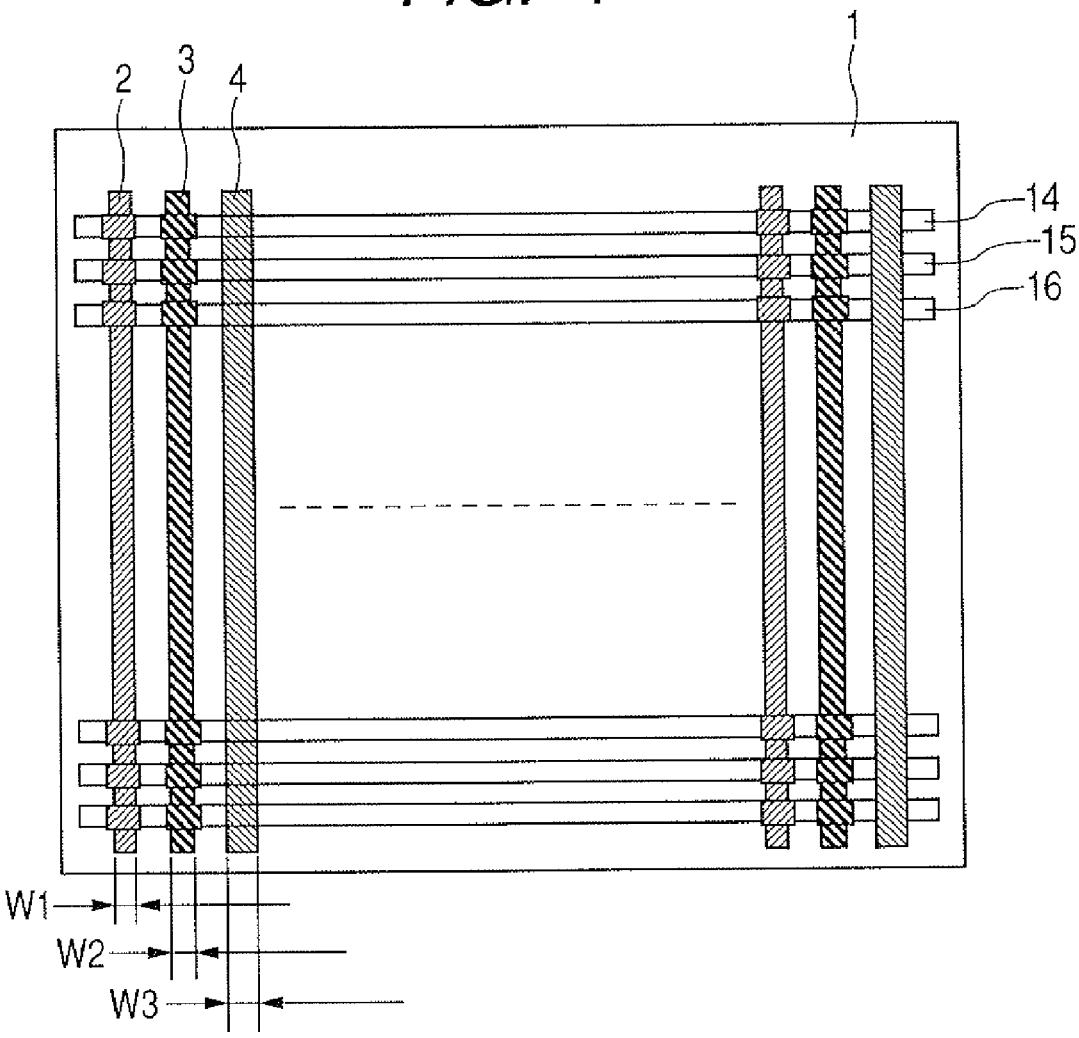
FIG. 1 is a plane view illustrating the image signal wirings of a display element according to First Embodiment of the present invention.

Next, exemplary embodiments of the present invention will be described with reference to appended drawings.

The aspect of the present invention is to reduce problems that are caused by the time lag between charge-discharge times occurring due to the wiring resistance and the capacitance on a drive substrate when it is driven by a constant voltage, that is the time lag between times required for respective light emitting elements to reach predetermined brightness when the image signal voltage is applied to the organic EL element.

Otherwise, the aspect of the present invention is to reduce problems that are caused by the time lag between charge-discharge times, occurring due to the wiring resistance and the capacitance on a drive substrate when it is driven by constant current, that is the time lag between times required for respective light emitting element to reach predetermined brightness with respect to application of the image signal voltage of the organic EL element, when it is driven by constant current.

The main aspect of the present invention is to provide a difference of wiring resistances or wiring capacitances to which pixels having light emitting elements emitting different colors, respectively, are connected.

A matrix display apparatus in which light emitting elements are arranged in row directions and column directions, in many cases, has a stripe arrangement in which different colors are periodically arranged in row directions, and same colors are arranged in column directions. Scanning signal wirings are provided in row directions and a scanning signal is applied to the scanning signal wiring to control the drive of the light emitting element in every row. Moreover, image signal wirings are provided in column directions, and an image signal is supplied to a light emitting element connected to the image signal wiring in a column direction. Even when different colors are arranged in column directions such as in delta arrangement, each image signal wiring is connected to light emitting elements of a same color while being bent in a column direction.

The present invention is applied to such a matrix display apparatus in which each image signal wiring is connected to light emitting elements of a same color.

In general, since the color of the light emitting element is determined by the luminescent material thereof, the light emission efficiency thereof differs every color. For this reason, voltage or current applied to the light emitting element of each color usually differs every color.

Since the voltage or the current is applied to the light emitting element through each image signal wiring from a drive circuit, the voltage or the current of the image signal wiring will differ depending on the color.

A constant amount of capacitance is attached to the image signal wiring, as a load, due to the parasitic capacitance caused by the intersection with the scanning line and the capacitance of a pixel including the light emitting element (hereinafter, the load capacitance is referred to as a wiring capacitance). If the wiring resistance and the wiring capacitance of the image signal wiring has same values, respectively, without depending on the color, rise time until voltage or current reaches to a stable state after they are changed, differs depending on the color. Therefore, even if voltage or current corresponding to a set brightness is applied, practical brightness containing a transitional change will shift from the brightness set by the rise time.

The aspect of the present invention is to cause the wiring resistance and the wiring capacitance of each image signal wiring to differ in a direction where the time rag between rise times during voltage change becomes smaller and uniform.

In order to change the wiring resistance of each image signal wiring according to color, means for, for example, wiring using different materials, wiring so as to be different wiring widths, and wiring so as to be different thicknesses, are used. Moreover, in order to change the wiring capacitance of each image signal wiring according to color, means for, for example, such as wiring the intersection point with respect to the scanning wiring at different wiring widths, wiring insulation layers of different thicknesses between the scanning wirings, and wiring insulation layers made of different materials between the scanning wirings.

This enables the above-mentioned problems to be coped with in view of the material manufacturing the display element, without using a large-scale drive circuit. In other words, even if an organic EL light emitting element, a light emission voltage of which is low and a charge-discharge time of which is short, and an organic EL light emitting element, a light emission voltage of which is high and a charge-discharge time of which is long are present on a panel in a mixed manner, the time lag between charge-discharge times of a capacitance being parasitic through the resistance of the wiring from the image signal voltage source and a hold capacitance, does not act severely on a display. Moreover, even if an organic EL light emitting element, a light emission current of which is large and a charge-discharge time of which is short, and an organic EL light emitting element, a light emission current of which is small and a charge-discharge time of which is long are present on a panel in a mixed manner, the time lag between charge-discharge times of capacitance being parasitic through the resistance of the wiring from the image signal current source, does not act severely on a display.

Accordingly, in a display element in which the drive voltage or the drive current differs depending on the color, it is possible to shorten the time lag between charge-discharge times caused by the wiring resistance and wiring capacitance on the drive substrate, without using a large-scale drive circuit. This enables the current drive display device to display well without smearing except for the display image.

Figure 24:
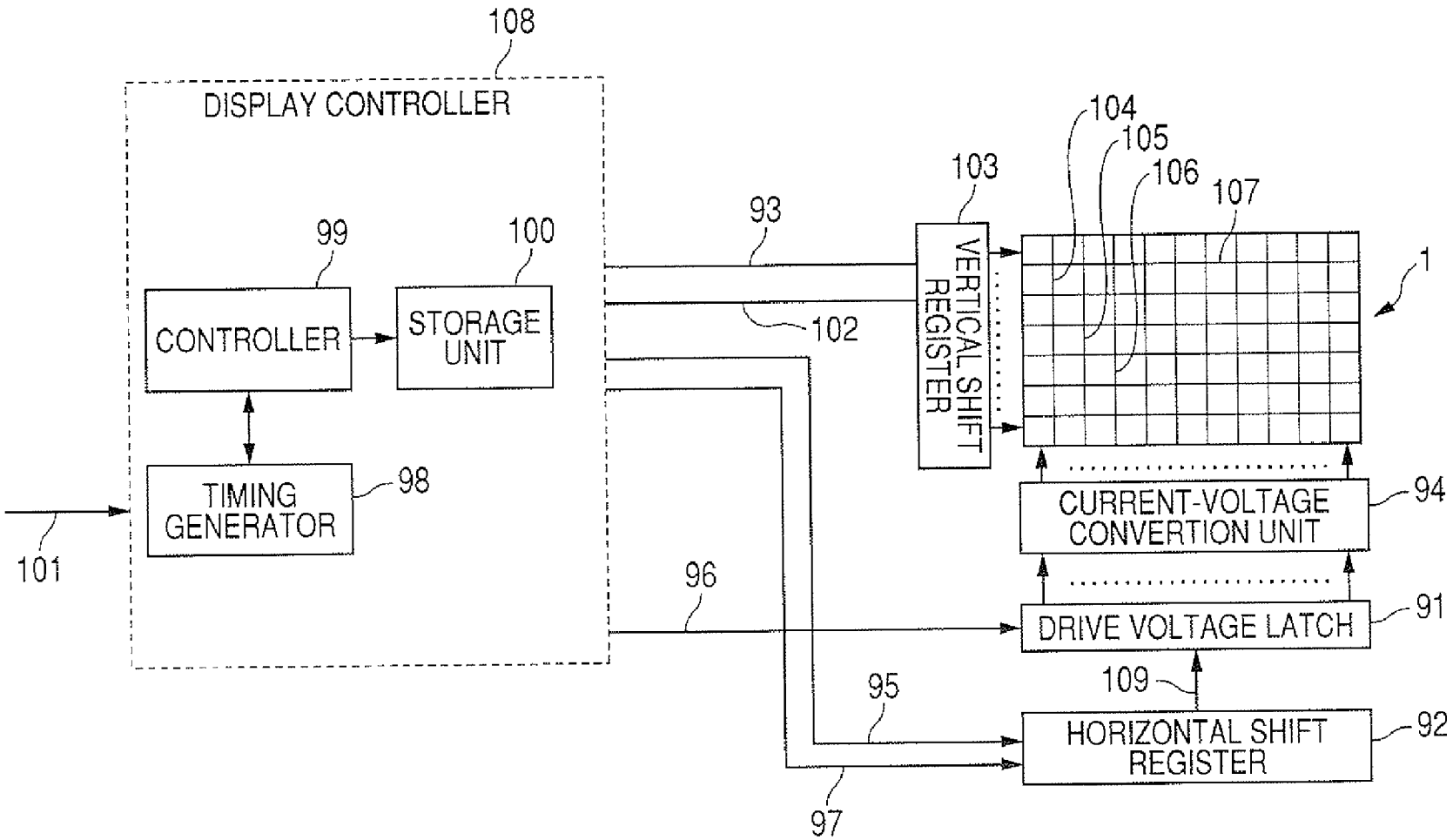
FIG. 24 is a block diagram illustrating the entire structure of a display system used for the display element in First to Sixth Embodiments.
Figure 25:
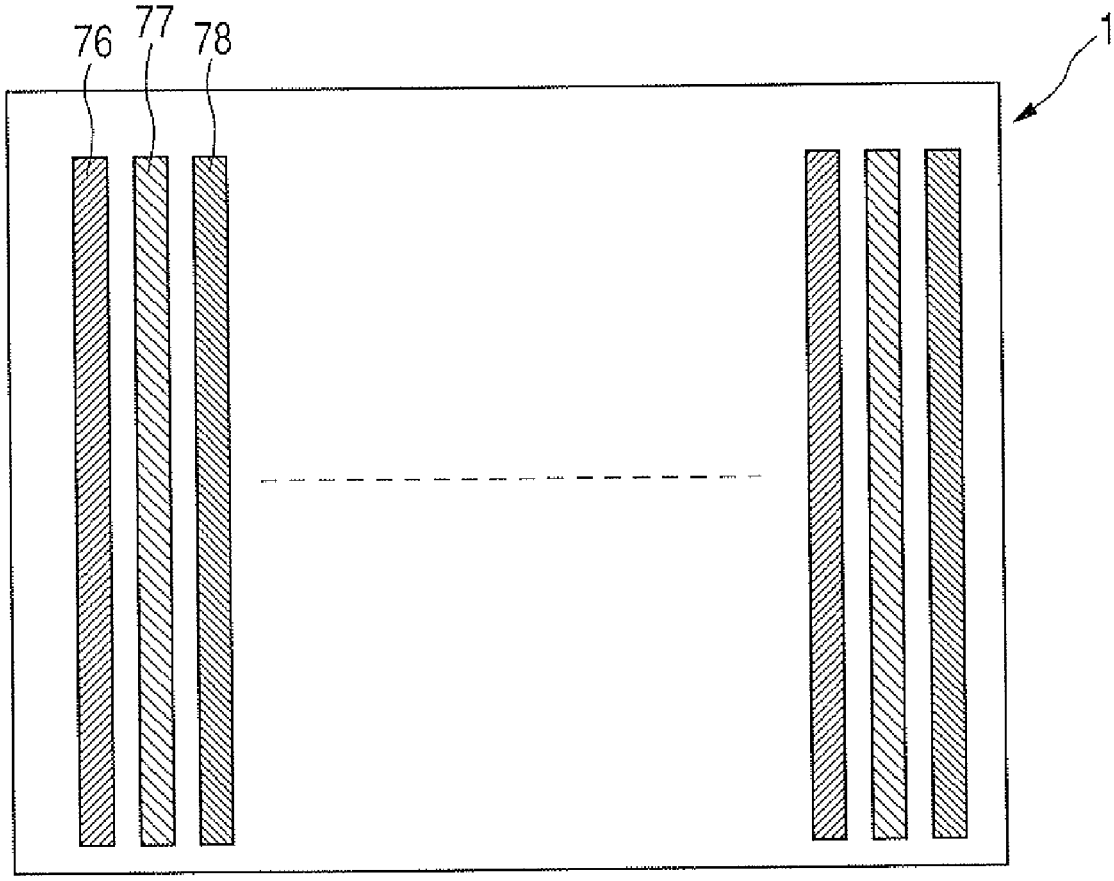
FIG. 25 is a plane view illustrating the image signal wirings of the display element in Prior Art Embodiment.

A display system illustrated in FIG. 24 includes a constant voltage drive type display element 1, a vertical shift resistor 103, a horizontal shift resistor 92, a drive voltage latch 91, a current-voltage conversion unit 94, and a display controller 108. The display controller 108 synchronizes the image data 101 supplied from outside under the control of a controller 99 with a timing generator 98 and store the data into a storage unit 100. The vertical shift register 103 is synchronized with a start pulse 93 from the display controller 108 and a shift clock 102, and sequentially selects and scans each scanning signal wiring 107 of the display element 1. The horizontal shift register 92 is synchronized with a start pulse 95 from the display controller 108 and a shift clock 97, and generates a latch signal 109. The drive voltage latch 91 latches the drive voltage signal 96 corresponding to the image data 101 from the display controller 108 by the latch signal 109 thereof. The current-voltage conversion unit 94 converts the latched drive voltage value into current, and synchronizes with the vertical shift register 103 to supply the current to each pixel of the display element 1, for every scanning line, through the image signal wirings 104 to 106. The display device 1 holds a capacitance corresponding to supplied drive voltage, and supplies drive current depending on this to an organic EL element to cause it to emit light.

Figure 17:
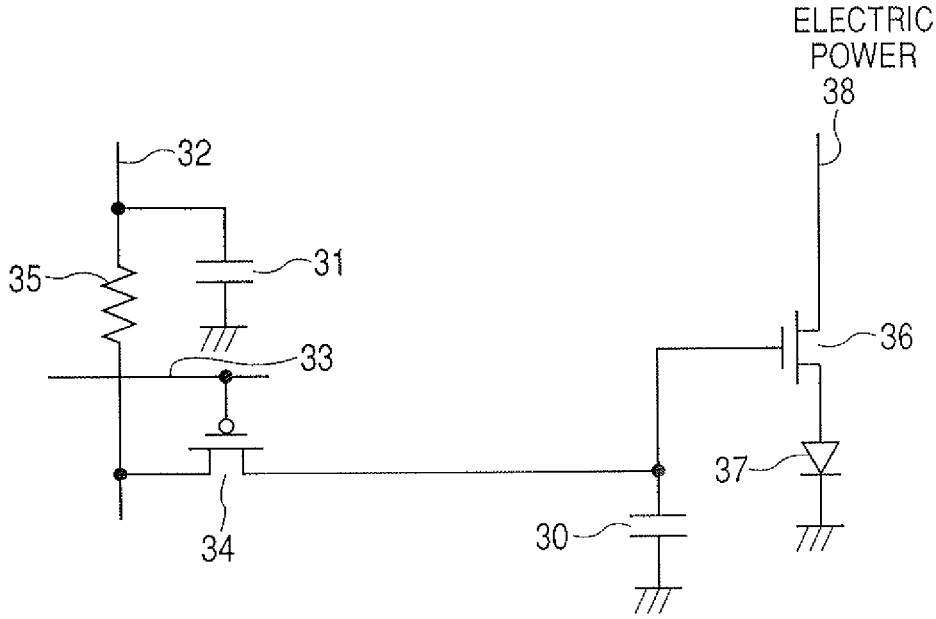
FIG. 17 is a circuit diagram illustrating the configuration of an inter-pixel constant voltage drive circuit used for a display element in First to Third Embodiments.
Figure 18:
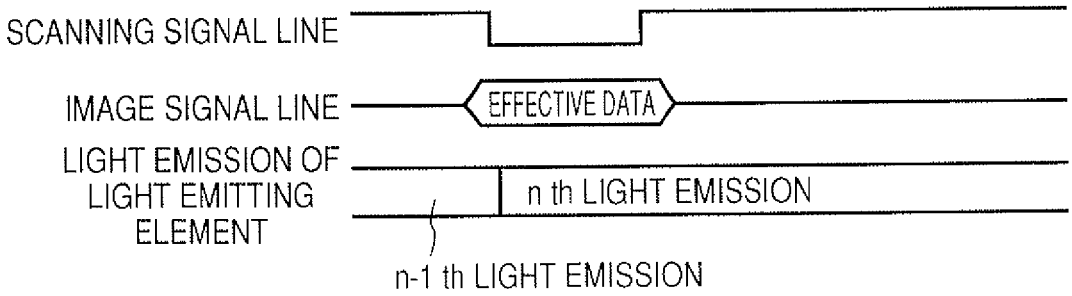
FIG. 18 is a timing chart illustrating the operation of the inter-pixel constant voltage drive circuit in FIG. 17.

FIG. 17 illustrates an example of a constant voltage drive circuit in a pixel performing the above-mentioned constant voltage drive. FIG. 18 is a timing chart describing the operation timing of the drive circuit illustrated in FIG. 17.

First, image signal voltage is applied through the image signal wiring 32. After that a scanning signal wiring 33 is selected, and TFT 34 in P channel will be in ON state. Thereby, in a capacitance 30, the image signal voltage level applied to the image signal wiring 32 is held. At that time, TFT 36 of N channel flows current corresponding to this setting voltage from an electric power 38 to an organic EL light emitting element 37. After that, the scanning signal wiring 33 is caused to be in a non-selected state, and TFT 34 of P channel will be in OFF state. After that, TFT 36 of N channel also continues to flow current corresponding to gate voltage set in the capacitance 30 to the organic EL light emitting element 37. By means of a series of the above-mentioned operations, the organic EL light emitting element 37 emits light.

Figure 21:
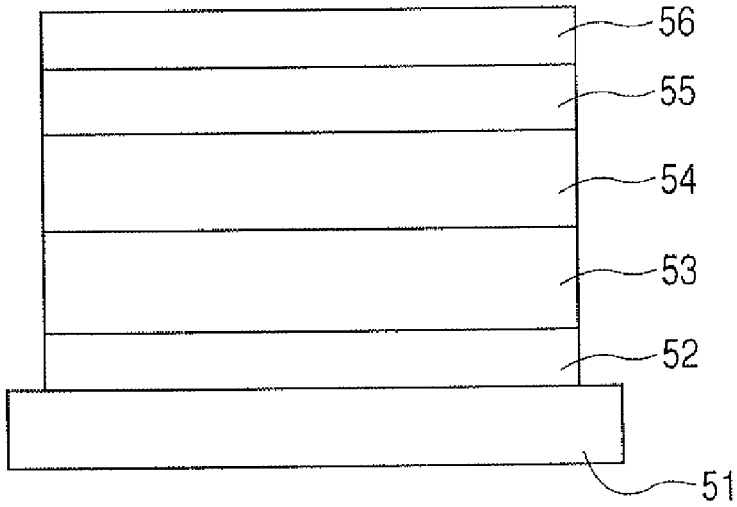
FIG. 21 is a view illustrating the configuration of an organic EL used for the display element in First to Sixth Embodiments.
Figure 22:
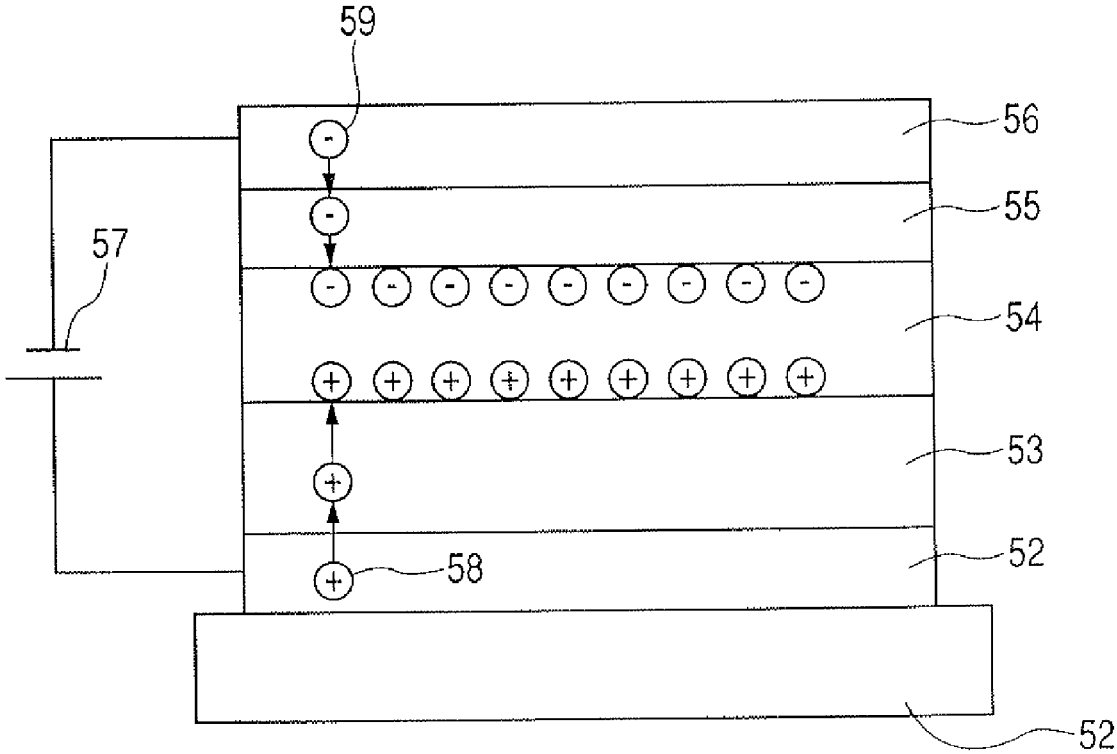
FIG. 22 is a view illustrating the light emission principle of the organic EL used for the display element in First to Sixth Embodiments.

FIGS. 21 and 22 are views illustrating an element configuration in the organic EL element where a stacked organic film is sandwiched between the anode and the cathode thereof. In FIGS. 21 and 22, a glass substrate 51, a transparent anode 52 such as ITO (Indium Tin Oxide), a hole transport layer 53, a light emission layer 54, an electron transport layer 55, a cathode 56, an electric power 57, holes 58, and electrons 59 are illustrated. As shown in FIG. 22, using the electric power 57 connected between the anode 52 and the cathode 56, positive voltage is applied to the anode 52 side, and negative voltage is applied to the cathode 56 side. Thereby, the holes 58 passed through the hole transport layer 53, and the electrons 59 passed through the electronic transport layer 55 form excitons in the light emission layer 54, and emit light by re-combination.

Figure 23A:
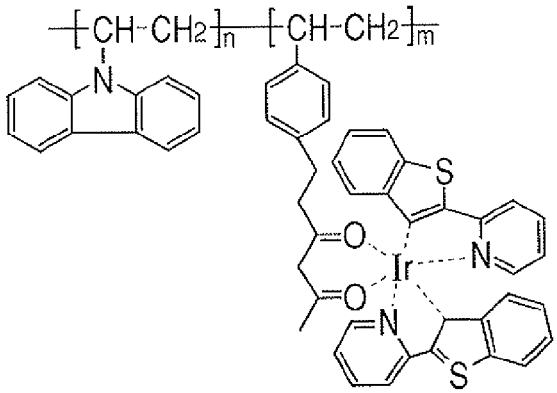
FIG. 23A is a view illustrating the molecular structure of a luminescent material used for the display element in First to Sixth Embodiments.
Figure 23B:
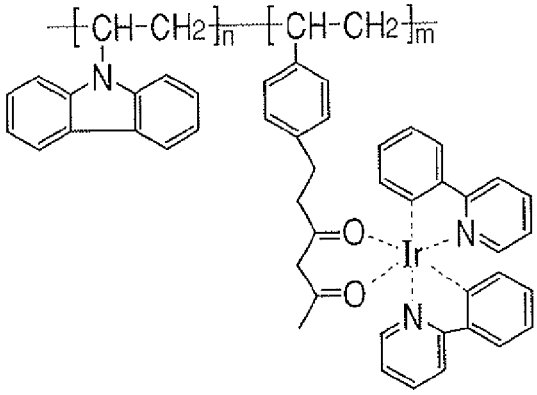
FIG. 23B is a view illustrating the molecular structure of another luminescent material used for the display element in First to Sixth Embodiments.
Figure 23C:
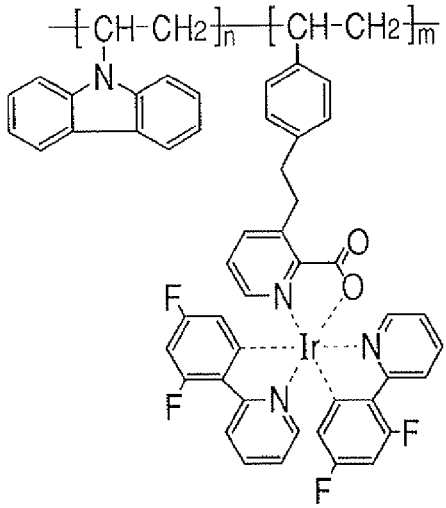
FIG. 23C is a view illustrating the molecular structure of still another luminescent material used for the display element in First to Sixth Embodiments.

Here, in the light emission layer of an organic EL element used for a pixel, materials such as materials emitting phosphorescence in a triplet state, whose structural formula are illustrated in FIGS. 23A to 23C, are used for luminescent materials of R, G and B, respectively. As for the luminescent materials illustrated in FIGS. 23A to 23C, phosphorescent polymer (molecular weight: 12000 to 16000) having a structure where an electric charge transport group (carbazole) carrying electric charges and a phosphorescent group (iridium complex) are connected in a chain, are used. In addition, as the phosphorescent materials, not only the iridium complexes but also other materials may be used. Moreover, as the luminescent materials, not only the phosphorescent materials but also fluorescent materials that have been used conventionally, may be used.

Pixels having a light emitting element using an organic EL element configured as above, as illustrated in the above-mentioned display element 1 in FIG. 24, are arranged in a matrix where image signal wirings 104, 105 and 106 are connected in column directions, and scanning wirings 107 are connected in row directions. In addition, the R image signal wiring 104, the G image signal wiring 105, and the B image signal wiring 106 are connected to pixels of R, G and B, respectively.

In such a substrate, as illustrated in FIG. 17 mentioned above, resistance 35 and capacitance 31 are parasitic in the image signal wirings to each pixel. The value of the resistance 35 is about 100 kΩ at the line end, and the value of the capacitance 31 is about 30 pF at the line end. Moreover, the value of the hold capacitance 30 is 5 pF. Due to the resistance and the capacitance, delay arises between the leading edge and the trailing edge of voltage. In a case of the above-mentioned capacitance and wiring resistance, when the rise waveforms of the brightness of the farthest pixels from a voltage source after an image signal voltage is applied, are observed, they are as in FIGS. 9 to 11.

Figures 8, 9:
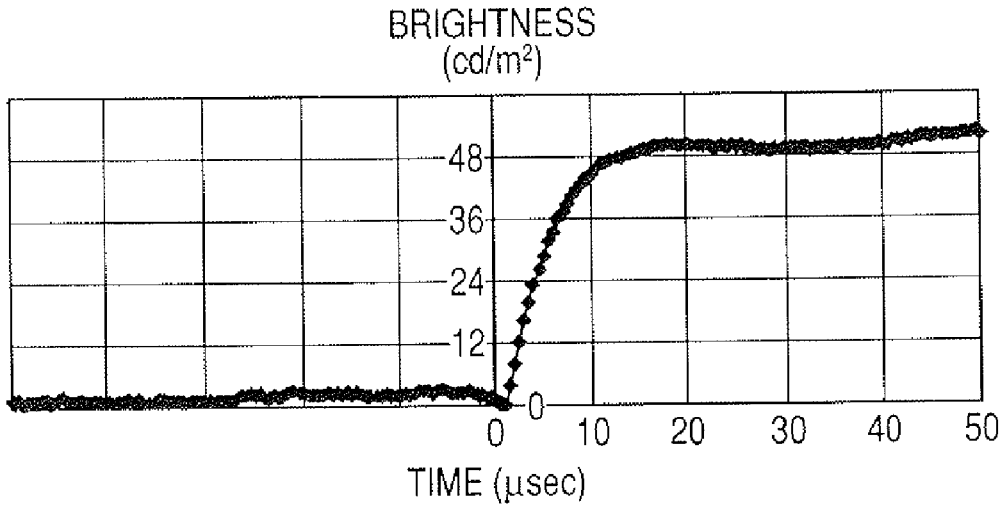
FIG. 8 is a view describing wiring materials and the relative dielectric constants thereof in Sixth Embodiment.
FIG. 9 is a graph illustrating a photo-response waveform with respect to the image signal of a pixel connected with a wiring including resistance and capacitance, in First to Third Embodiments.
Figure 10:
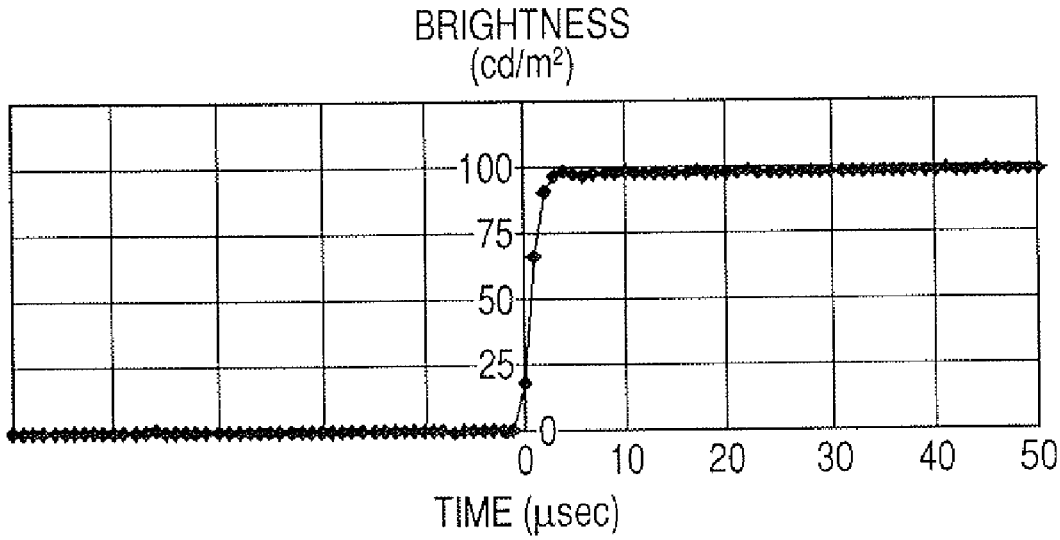
FIG. 10 is a graph illustrating another photo-response waveform with respect to the image signal of a pixel connected with a wiring including resistance and capacitance, in First to Third Embodiments.
Figure 11:
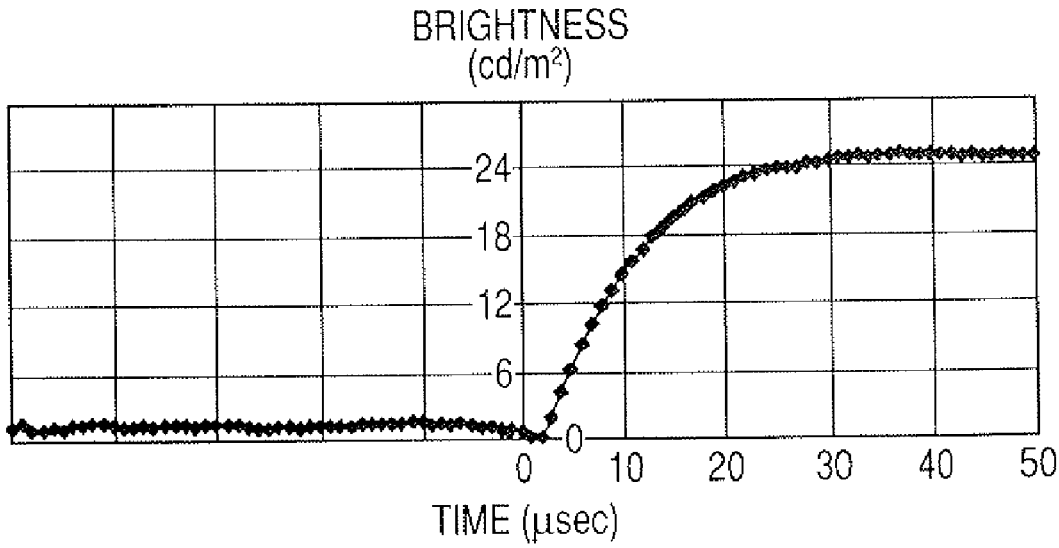
FIG. 11 is a graph illustrating still another photo-response waveform with respect to the image signal of a pixel connected with a wiring including resistance and capacitance, in First to Third Embodiments.

FIG. 9 is a rise waveform of R image signal wiring, FIG. 10 is a rise waveform of G image signal wiring, and FIG. 11 is a rise waveform of B image signal wiring. Here, since image signal wiring voltage for a light emission element of B>image signal wiring voltage for a light emission element of G>image signal wiring voltage for a light emission element of R, the rise times thereof to a predetermined brightness are in this order. As the image signal voltage becomes higher, longer times are required by the relationship: $t=C\times V\div i$ (where, t: charge time; C: capacitance; V: voltage; and i: current). In addition vertical axes of graphs in FIGS. 9 to 11 are the voltage outputs of a photomultiplier measuring photo-response.

If there are fluctuations in rise times, the brightness will be shifted from a value set by current. If the rise time is slow, the brightness will be lower than the value set by current, resulting in imbalance of white balance. Therefore, rise times must be equal to each other for R, G and B.

Herein after, specific embodiments of the present invention will be described.

First Embodiment

First, First Embodiment of the present invention will be described in detail with reference to the drawings. In this embodiment, an organic EL element is applied to a display element configured to be driven by constant voltage.

In a display element 1 having light emitting pixels of R, G and B, the required brightness when white balance is considered is 50 cd/m$^2$ for R, 100 cd/m$^2$ for G, and 25 cd/m$^2$ for B, the required drive current at that time is 60 μA for R, 166 μA for G, and 159 μA for B, and the voltage applied to the organic EL element for flowing the current, is 6 V for R, 5 V for G, and 4 V for B, as the gate voltage of the drive TFT.

In this embodiment, wirings are arranged so that the wiring width of the corresponding image signal wiring differs every color of pixels. In other words, as illustrated in FIG. 1, R image signal wiring 2 is patterned to be of wiring width W1 of 3.3 μm, G image signal wiring 3 is patterned to be of wiring width W2 of 4.2 μm, and B image signal wiring 4 is patterned to be of wiring width W3 of 5 μm (W1<W2<W3). In addition, the widths of intersections with respect to scanning signal wirings 14, 15 and 16 are still 5 μm.

At that time, wiring resistances of each image signal wirings are 100 kΩ for R, 120 kΩ for G, and 150 kΩ for B. Since a superposed area at the intersection part between the image signal wiring and the scanning wiring are equal for R, G and B, wiring capacitances for R, G and B will be a same value.

Figures 14, 15:
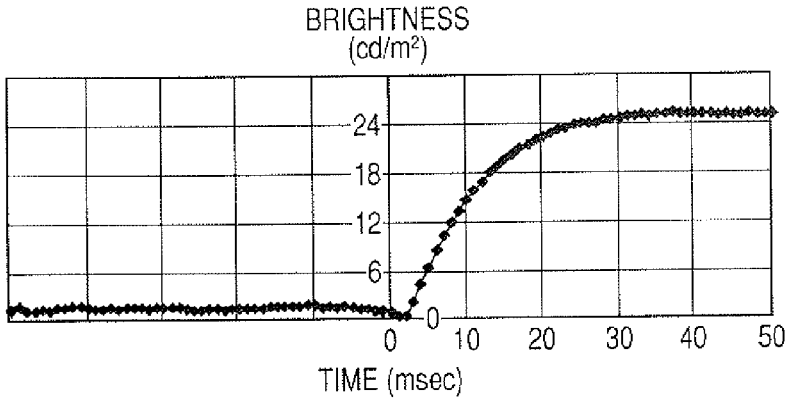
FIG. 14 is a graph illustrating still another photo-response waveform with respect to the image signal of a pixel connected with a wiring including capacitance, in Fourth to Sixth Embodiments.
FIG. 15 is a view describing wiring resistances and times required to charging the capacitance thereof, in First to Third Embodiments.

FIG. 15 illustrates the results of more quantitative calculation of the above-mentioned photo-responses.

As for the numbers provided in each row in FIG. 15, the number in left end column indicates voltage (V), the numbers in the right three columns indicate rise times (μs) of signal wirings for R, G and B in this order. The voltage is a voltage applied to the organic EL element+the gate voltage of the drive TFT.

By assuming that the data line capacitance is 30 pF and the hold capacitance is 5 pF, the capacitance load is assumed to be 35 pF that is the summation of them.

Since the data line resistance of R is set to 100 kΩ, when the gate voltage is 6 V and current is 60 μA, the rise time becomes 19.87 μs. Moreover, since the data line resistance of G is set to 120 kΩ, the rise time when the gate voltage is 5 V and current is 166 μA, also becomes 19.87 μs, and since the data line resistance of B is set to 150 kΩ, the rise time when the gate voltage is 4 V and current is 159 μA, also becomes 19.87 μs.

Figure 26:
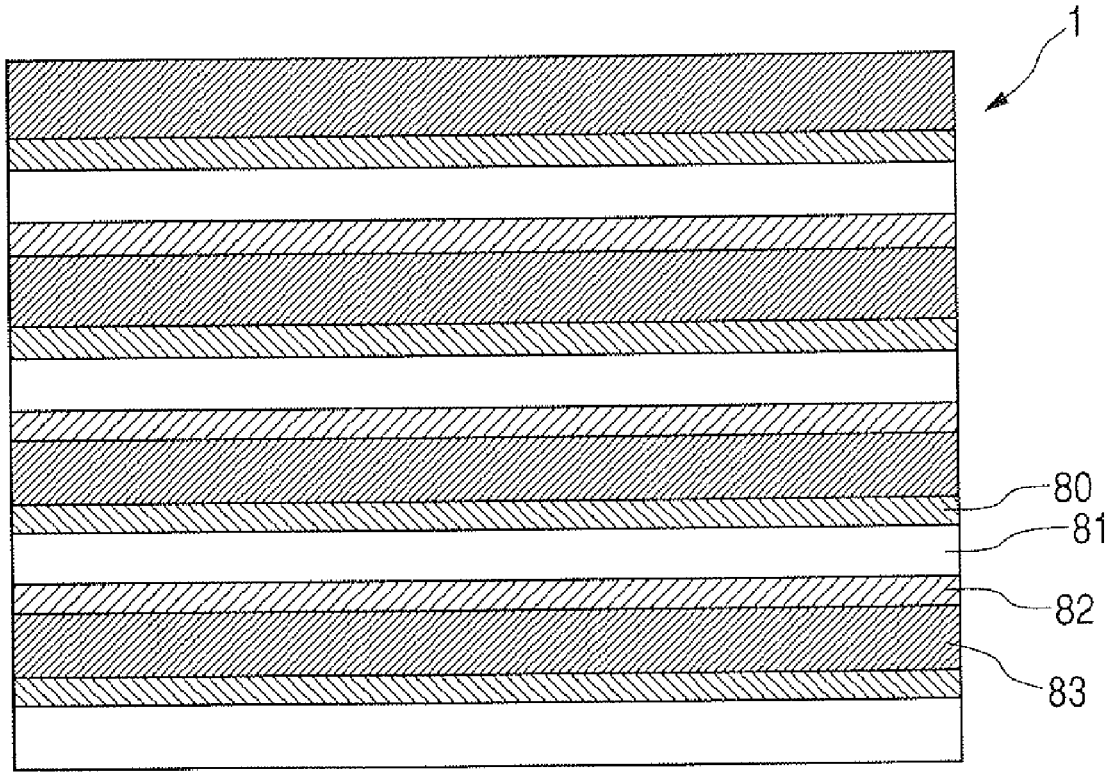
FIG. 26 is a view illustrating the image signal wiring of the display element in Prior Art Embodiment.

According to simulation, the rise waveform of image signal wiring for R become such a wave form illustrated in FIG. 10, and the rise times for G image signal wiring and B image signal wiring also become substantially equal to the rise time for R image signal wiring. As the result, the shift of light emission for each color as illustrated in FIG. 26, will not be observed.

Second Embodiment

Next, Second Embodiment of the present invention will be described in detail with reference to the drawings. In this Embodiment, similar to First Embodiment, an organic EL element is also applied to a display element configured to be driven by constant voltage. In addition, descriptions of similar components as those in First Embodiment will be simplified or eliminated.

Figure 2:
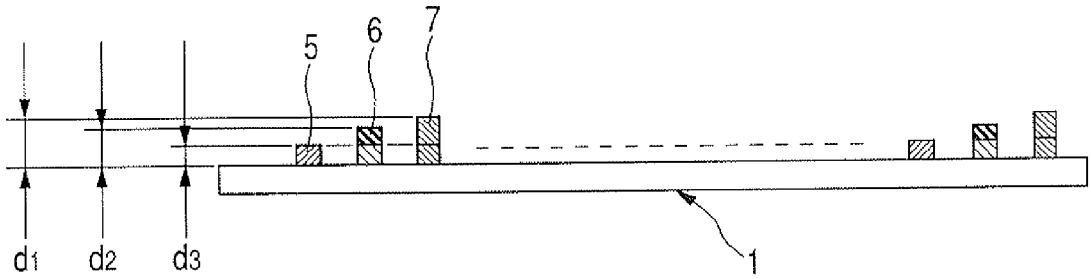
FIG. 2 is a side view illustrating the image signal wirings of a display element according to Second Embodiment of the present invention.

In this embodiment, wirings are arranged so that the wiring width of the corresponding image signal wiring differs every color of pixels. In other words, as illustrated in FIG. 2, R image signal wiring 5 is patterned to be of thickness d1 of 330 nm, G image signal wiring 6 is patterned to be of thickness d2 of 420 nm, and B image signal wiring 7 is patterned to be of thickness d3 of 500 nm (d1<d2<d3). By this, the relationship between the drive voltage and the wiring time constant is adjusted every color depending on the difference between the wiring resistances, thereby, resulting in that the rise waveforms for R, G and B will have substantially a same rise time for the three colors.

Third Embodiment

Next, Third Embodiment of the present invention will be described in detail with reference to the drawings. In this Embodiment, similar to First Embodiment, an organic EL element is also applied to a display device configured to be driven by constant voltage. In addition, descriptions of similar components as those in First Embodiment will be simplified or eliminated.

Figure 3:
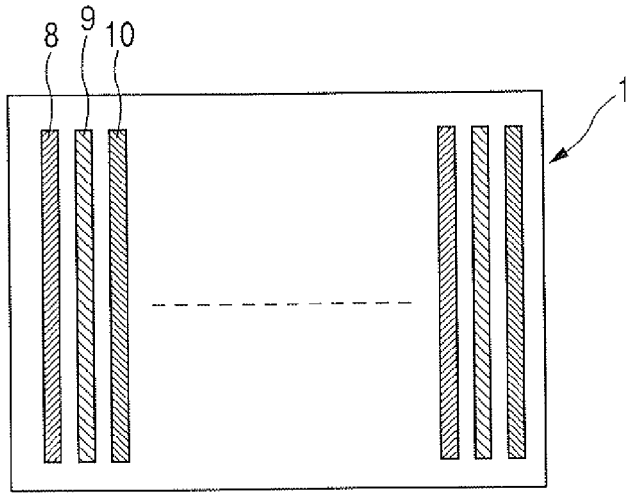
FIG. 3 is a plane view illustrating the image signal wirings of a display element according to Third Embodiment of the present invention.
Figures 6, 7:
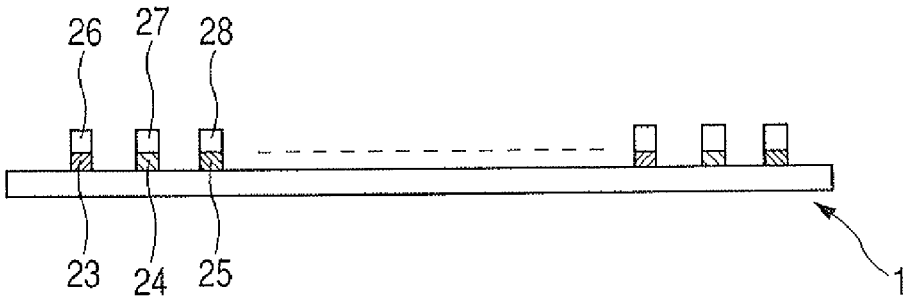
FIG. 6 is a side view illustrating the image signal wirings of a display element according to Sixth Embodiment of the present invention.
FIG. 7 is a view describing wiring materials and the resistivity thereof in Third Embodiment.

In this embodiment, wirings are arranged so that the material used for wiring the corresponding image signal wiring differs every color of pixels. In other words, as illustrated in FIG. 3, patterning for R image signal wiring 8 uses Cr material, for G image signal wiring 9 uses Mo material, and for B image signal wiring 10 uses Al material. Resistivity of each wiring material is illustrated in FIG. 7, that is 12.7 μΩcm for Cr, 5 μΩcm for Mo, and 2.5 μΩcm for Al.

By the difference of wiring materials for each color, the relationship between the drive voltage and the wiring time constant is adjusted every color, thereby, resulting in that the rise waveforms for R, G and B will have substantially a same rise time for the three colors.

Fourth Embodiment

Next, Fourth Embodiment of the present invention will be described in detail with reference to the drawings. In this Embodiment, an organic EL element is applied to a display device configured to be driven by constant current. In addition, since the element configuration of the organic EL element is similar to those in FIGS. 21 and 22, the luminescent material is similar to that in FIGS. 23A, 23B and 23C, and the entire configuration of the display device is similar to that in FIG. 24, descriptions thereof will be eliminated.

Figure 19:
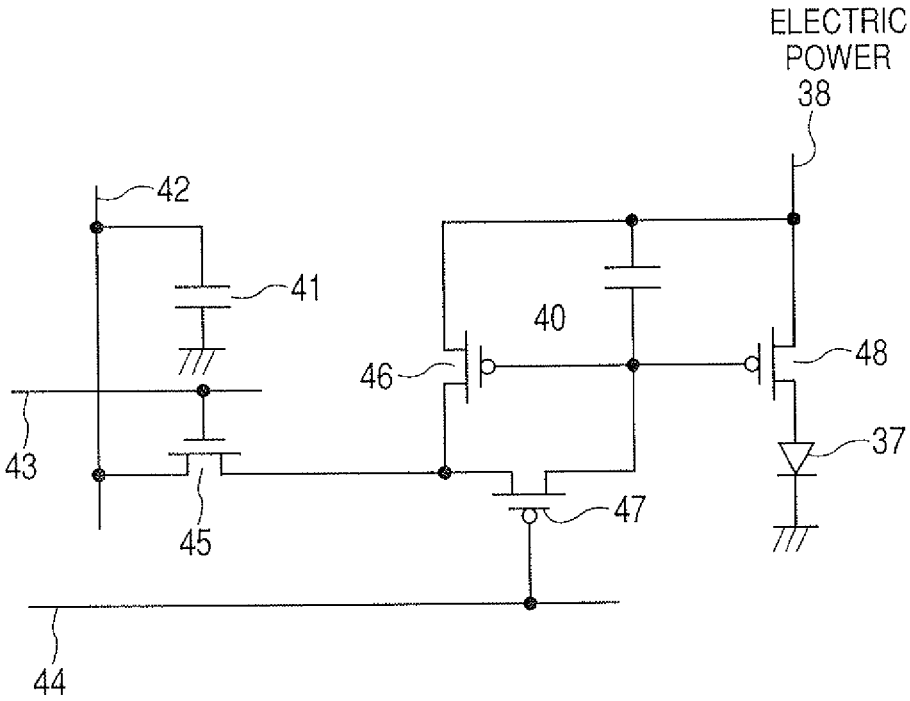
FIG. 19 is a circuit diagram illustrating the configuration of an inter-pixel constant voltage drive circuit used for the display element in Fourth to Sixth Embodiments.
Figure 20:
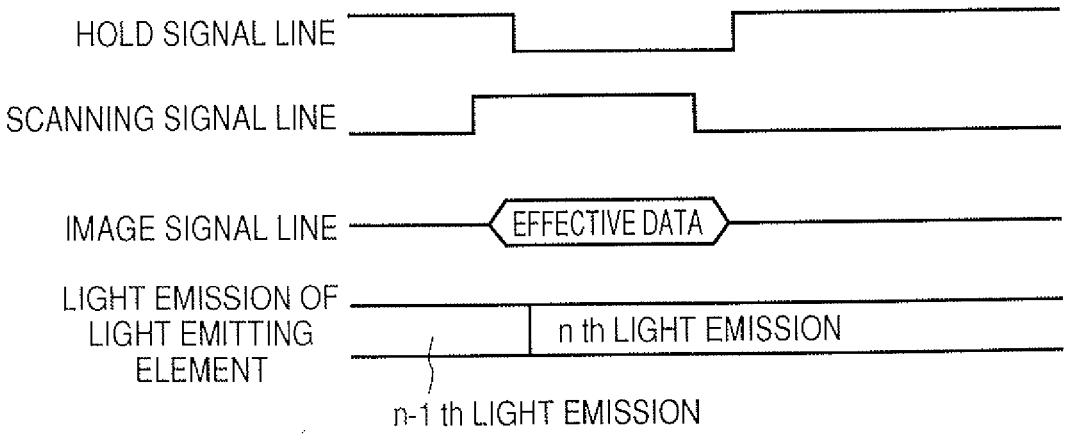
FIG. 20 is a timing chart illustrating operation of the inter-pixel constant voltage drive circuit in FIG. 19.

FIG. 19 illustrates an example of an inter-pixel constant current drive circuit performing constant current drive. The circuit is used for, for example, such as the active-matrix type organic EL display element subjected to current drive disclosed in Japanese Patent Application Laid-Open No. 2001-147659. FIG. 20 is a timing chart describing the drive timing of the circuit illustrated in FIG. 19.

First, a scanning signal wiring 43 is selected, and TFT 45 of N channel turns into ON state. Then, drive current is applied to an organic EL light emitting element 37 through an image signal wiring 42 to cause it to be in an effective state. After that, a hold signal wiring 44 is selected, and TFT 47 of P channel turns into ON state. By this, TFT 46 of P channel flows the drive current into the channel thereof, to generate a conversed voltage level at the gate thereof, and capacitance 40 holds the voltage level generated at the gate of TFT 46. At that time, TFT 48 of P channel flows current set in this time into the organic EL light emitting element 37. Next, when the hold signal wiring 44 is out of selection and TFT 47 is turned into OFF state, TFT 48 of P channel flows constant current corresponding to the voltage level of the hold capacitance 40 into the organic EL light emitting element 37. By the above-mentioned series of operations, the organic EL light emitting element 37 emits light.

Pixels having the light emitting elements are arranged in a matrix, where image signal wirings 104, 105 and 106 are connected in column directions, and scanning signal wirings 107 are connected in row directions, as illustrated in the above-mentioned display element 1 in FIG. 24. In addition, the R image signal wiring 104, the G image signal wiring 105, and the B image signal wiring 106 are connected to pixels of R, G and B, respectively.

In such a substrate, as illustrated in FIG. 19 mentioned above, capacitance 41 is parasitic in the image signal wirings to each pixel. The value of the capacitance 41 is 10 to 20 pF, and substantially proportional to the length of the wiring. In a case of the capacitance 41 and the wiring resistance, when the rise waveforms of the brightness of the farthest pixels from a current source after an image signal current is applied, are observed, they are as in FIGS. 12 to 14.

Figure 12:
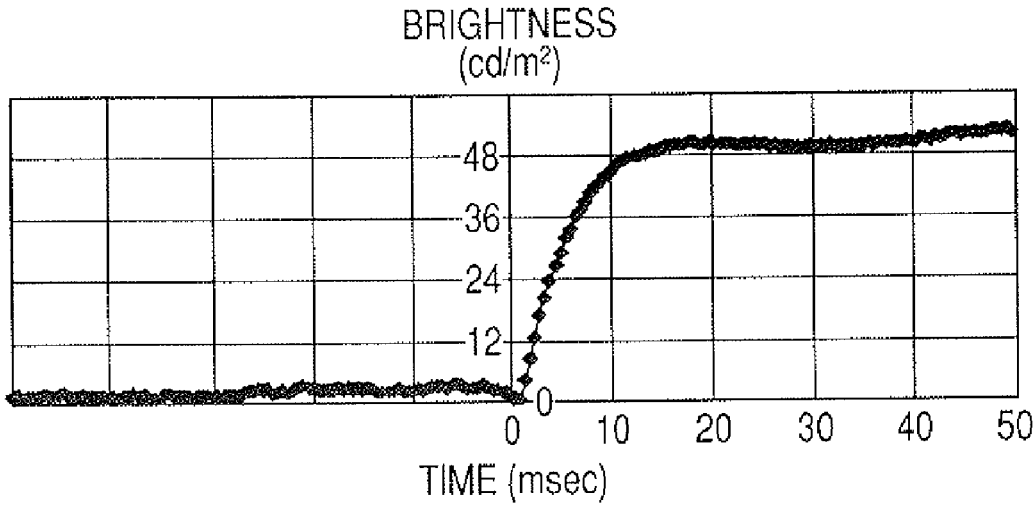
FIG. 12 is a graph illustrating a photo-response waveform with respect to the image signal of a pixel connected with a wiring including capacitance, in Fourth to Sixth Embodiments.
Figure 13:
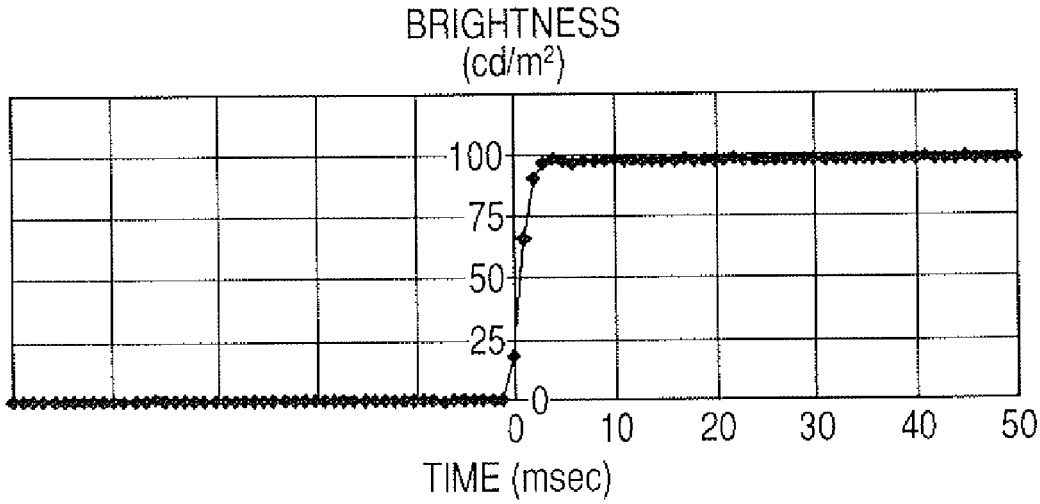
FIG. 13 is a graph illustrating another photo-response waveform with respect to the image signal of a pixel connected with a wiring including capacitance, in Fourth to Sixth Embodiments.

FIG. 14 is a rise waveform of B image signal wiring, FIG. 13 is a rise waveform of G image signal wiring, and FIG. 12 is a rise waveform of R image signal wiring. Here, since drive current for a light emission element of B>drive current for a light emission element of G>drive current for a light emission element of R, the rise times thereof upto a predetermined brightness are in this order. As the drive current becomes smaller, longer times are required by the relationship: $t=C\times V\div i$ (where, t denotes charge time; C denotes capacitance; V denotes voltage; and i denotes current). In addition vertical axes of graphs in FIGS. 12 to 14 represent the voltage output of a photomultiplier measuring photo-response.

FIG. 16 illustrates the results of more quantitative calculation of the above-mentioned responses. Here, Voltage indicates voltage values applied to the organic EL element, and each value indicated at the crossing points of Current and Voltage indicates a time required for charging the data wiring to current and voltage values corresponding to target brightness. For example, the voltage for obtaining 1000 cd/m$^2$ under large drive current of 80.8 nA is 3 V, and the charge-discharge time of data wiring at that time is 0.371 mS. In addition, in this embodiment, the charge-discharge times of data wiring illustrated in FIG. 16 are calculated by assuming that the data line capacitance is 10 pF.

In a display element 1 having light emitting pixels for R, G and B, required brightnesses by considering white balance are 50 cd/$m^2$ for R, 100 cd/$m^2$ for G, and 25 cd/$m^2$ for B. At that time, current of 161.6 nA flows into the image signal wiring 104 for R, current of 323.2 nA flows into the image signal wiring 105 for G, and current of 1028 nA flows into the image signal wiring 106 for B. Moreover, voltages at that time are 2.1 V, 2.4 V and 2.7 V, respectively. When reading the charge times at that time in FIG. 16, they are 0.124 mA, 0.071 mA and 0.025 mA, respectively.

Figure 4:
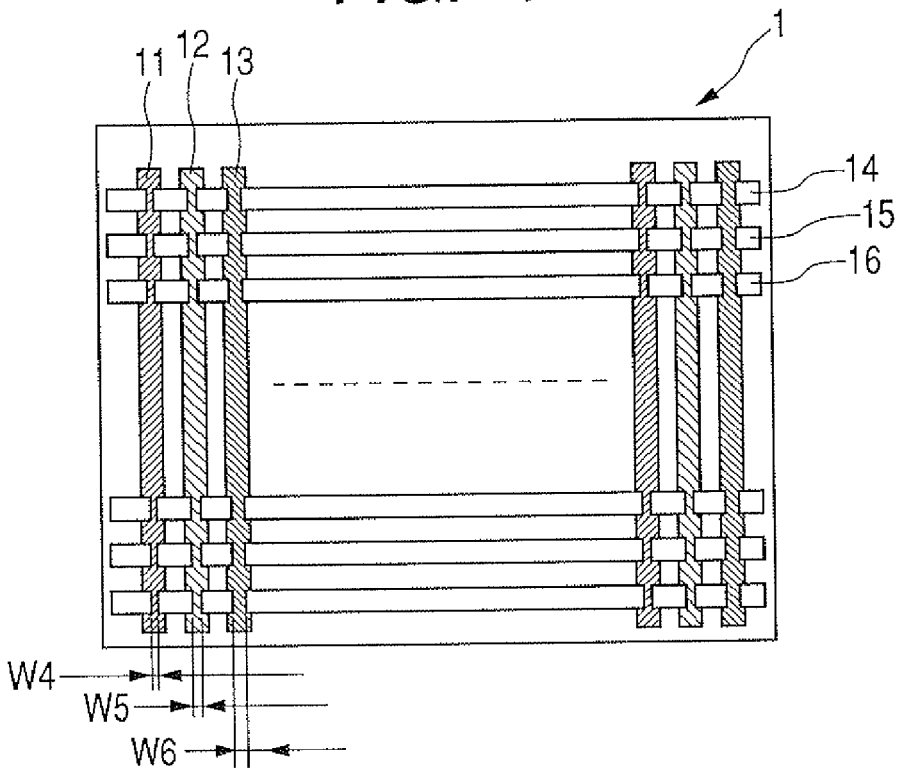
FIG. 4 is a plane view illustrating the image signal wirings of a display element according to Fourth Embodiment of the present invention.

In this embodiment, in order to cause charge times to be equal, wirings are arranged so that, in the image signal wiring, the wiring width of the wiring intersection with respect to the scanning signal wiring differs every color of pixels. In other words, as illustrated in FIG. 4, R image signal wiring 11 is patterned so that the wiring width W4 of the intersection thereof with respect to the scanning signal wiring for scan (gate line) 14 becomes 1 μm. Moreover, G image signal wiring 12 is patterned so that the wiring width W5 of the intersection thereof with respect to the scanning signal wiring for scan (gate line) 14 becomes 2.9 μm. Further, B image signal wiring 13 is patterned so that the wiring width W6 of the intersection thereof with respect to the scanning signal wiring for scan (gate line) 14 becomes 5 μm (W4<W5<W6).

By this the relationship between the drive current and the wiring time constant is adjusted every color depending on the difference between wiring capacitances. According to simulation, the rise waveform of R image signal wiring became such a wave form illustrated in FIG. 13, and the rise time thereof were substantially equal to the rise times of G image signal wiring and B image signal wiring. As the result, the shift of light emission for each color as illustrated in FIG. 26, would not be observed.

Fifth Embodiment

Next, Fifth Embodiment of the present invention will be described in detail with reference to the drawings. In this Embodiment, similar to First Embodiment, an organic EL element is also applied to a display element configured to be driven by constant current. In addition, regarding to similar components as those in First Embodiment, descriptions thereof will be simplified or eliminated.

Figure 5:
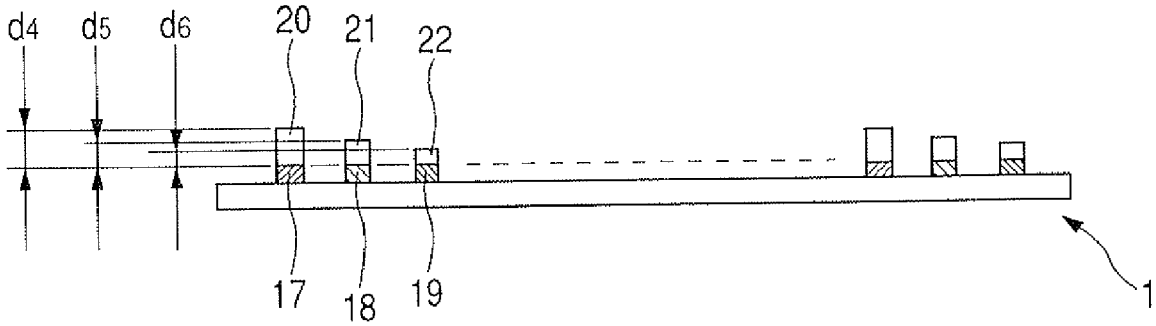
FIG. 5 is a side view illustrating the image signal wirings of a display element according to Fifth Embodiment of the present invention.

In this embodiment, wirings are arranged so that, in the image signal wiring, the thickness of an insulation film between the image signal wiring and the scanning signal wiring differs every color of pixels. In other words, as illustrated in FIG. 5, R image signal wiring 17 is patterned so that the thickness d4 of an insulation film 20 between R image signal wiring 17 and the scanning signal wiring for scan (gate line) (not illustrated in the figure) becomes 500 nm. Moreover, G image signal wiring 18 is patterned so that the thickness d5 of an insulation film 21 between G image signal wiring 18 and the scanning signal wiring becomes 290 nm. Further, B image signal wiring 19 is patterned so that the thickness d6 of an insulation film 22 between B image signal wiring 19 and the scanning signal wiring becomes 100 nm (d4>d5>d6).

By this, the relationship between the drive current and the wiring time constant is adjusted every color depending on the difference between wiring capacitances, thereby, similar to Fourth Embodiment, the rise waveforms for R, G and B become substantially similar to each other.

Sixth Embodiment

Next, Sixth Embodiment of the present invention will be described in detail with reference to the drawings. In this Embodiment, similar to First Embodiment, an organic EL element is also applied to a display element configured to be driven by constant current. In addition, regarding to similar components as those in First Embodiment, descriptions thereof will be simplified or eliminated.

In this embodiment, wirings are arranged so that, in the image signal wiring, the material of an insulation film between the image signal wiring and the scanning signal wiring differs every color of pixels. In other words, as illustrated in FIG. 6, R image signal wiring 23 is patterned by using $SiO_2$ as the material of an insulation film 26 between R image signal wiring 23 and the scanning signal wiring for scan (gate line) (not illustrated in the figure). Moreover, G image signal wiring 18 is patterned by using $Si_3N_4$ as the material of an insulation film 27 between G image signal wiring 24 and the scanning signal wiring. Further, B image signal wiring 25 is patterned by using $Ta_2O_5$ as the material of an insulation film 28 between B image signal wiring 25 and the scanning signal wiring.

The relative dielectric constants of each wiring material are illustrated in FIG. 8, that is 4.0 for $SiO_2$, 9.0 for $Si_3N_4$, and 25.0 for $Ta_2O_5$. By the difference between the materials of the insulation film in the relative dielectric constant, the relationship between the drive current and the wiring time constant is adjusted every color, thereby, similar to Fourth Embodiment, the rise waveforms for R, G and B become substantially similar to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-181667, filed on Jun. 30, 2006, which is hereby incorporated by reference herein in its entirety.

What is claimed is:

1. A display apparatus comprising:

an array of light emitting elements in which light emitting elements of different colors are arranged periodically in a row direction and light emitting elements of a same color are arranged in a column direction;

a plurality of scanning signal wirings connecting the light emitting elements in the row direction; and a plurality of image signal wirings connecting the light emitting elements arranged in columns and thereby supplying an image signal to the light emitting elements in the columns, wherein each image signal wiring is connected to light emitting elements of a same color in the column direction and the light emission efficiencies of the light emitting elements are different for every color, and wiring resistance or wiring capacitance of each image signal wiring differs correspondingly to the color of the light emitting elements in a corresponding column so as to reduce unevenness of rise times of voltages applied to the respective image signal wirings, wherein the image signal is a voltage signal, and wherein a width of the plurality of image signal wirings differs depending on the color of the light emitting elements arranged in the corresponding column except at intersections between the image signal wirings and the scanning signal wirings where the width of the plurality of image signal wirings is the equal regardless of the color of the light emitting elements arranged in the corresponding column.

2. The display apparatus according to claim 1, wherein the width of the plurality of image signal wirings at intersections between the image signal wirings and the scanning signal wirings is the same as that of the image signal wiring which supplies the image signal to the light emitting elements of the blue color.

* * * * *